US006126464A

United States Patent [19]

Chang

[11] Patent Number: 6,126,464

[45] Date of Patent: Oct. 3, 2000

[54] CARD CONNECTOR HAVING SWITCHING MEANS

[75] Inventor: Jen Jou Chang, Yung-Ho, Taiwan

[73] Assignee: Hon Hai Precision Ind. Co., Ltd., Taipei Hsien, Taiwan

[21] Appl. No.: 09/218,753

[22] Filed: Dec. 22, 1998

[30] Foreign Application Priority Data

Jun. 6, 1998 [TW] Taiwan ..... 87208967

[51] Int. Cl.[7] ..... H01R 29/00

[52] U.S. Cl. ..... 439/188; 439/489; 235/441

[58] Field of Search ..... 439/188, 489; 235/441

[56] References Cited

U.S. PATENT DOCUMENTS

| | | | |
|---|---|---|---|
| 4,514,030 | 4/1985 | Triner et al. | 439/188 |
| 5,259,777 | 11/1993 | Schuder et al. | 439/188 |
| 5,334,827 | 8/1994 | Bleier et al. | 235/492 |
| 5,667,397 | 9/1997 | Broschard, III et al. | 439/188 |
| 5,924,881 | 7/1999 | Yasushi et al. | 439/188 |
| 6,039,599 | 3/2000 | Benjamin et al. | 439/489 |

*Primary Examiner*—Brian Sircus
*Assistant Examiner*—Michael C. Zarroli
*Attorney, Agent, or Firm*—Wei Te Chung

[57] ABSTRACT

A card connector comprises a main body, a cover attached to a bottom face of the main body, and switching means disposed between the main body and the cover. The switching means comprises a first portion and a second portion. The first portion includes a first leg and a second leg parallel to the first leg. The second leg forms a V-shaped projection adjacent to a free end thereof and projecting beyond a top face of the main body. The free end of the second leg electrically contacts the second portion. When a card is inserted into the card connector, a front edge thereof will slide along the V-shaped projection of the switching means thereby causing the free end of the second leg to electrically disengage from the second portion.

9 Claims, 6 Drawing Sheets

CARD CONNECTOR HAVING SWITCHING MEANS

BACKGROUND OF THE INVENTION

1. Field of the Invention

The present invention relates to an electrical card connector having switching means, and particularly to a card connector having switching means of a simplified structure which is activated before full insertion of the card is achieved.

2. The Prior Art

Computers of all types are commonly equipped with card connectors for receiving electrical cards therein. The cards serve many purposes such as increasing the memory of the computer, expanding the capabilities of the computer, or transferring files from one computer to another computer. For certain applications, it is desirable for the card connector to detect and respond to the insertion of a card for the purpose of executing preset functions.

U.S. Pat. No. 5,334,034 discloses a card connector having a card insertion indicating switch. However, the switch has a complicated structure and fastening means is required to attach the switch to a main body of the connector. Thus, assembly becomes laborious and manufacturing costs are increased. Hence, a switching means for a card connector having a simplified structure is requisite to overcome the disadvantages of the prior art.

SUMMARY OF THE INVENTION

An objective of the present invention is to provide an electrical card connector with switching means having a simple structure.

Another objective of the present invention is to provide an electrical card connector equipped with switching means whereby specific electrical circuitry may be activated before full insertion of a card.

A further objective of the present invention is to provide a simplified method for assembling switching means within an electrical card connector.

To fulfill the above mentioned objectives, a card connector in accordance with the present invention comprises a main body, a cover attached to a bottom face of the main body, and switching means disposed between the main body and the cover. The switching means comprises a first portion and a second portion. The first portion includes a first leg and a second leg parallel to the first leg. The second leg forms a V-shaped projection adjacent to a free end thereof and projecting beyond a top face of the main body. The free end of the second leg electrically contacts the second portion. When a card is inserted into the card connector, a front edge thereof will slide along the V-shaped projection of the switching means thereby causing the free end of the second leg to electrically disengage from the second portion.

These and additional objectives, features, and advantages of the present invention will become apparent after reading the following detailed description of the preferred embodiment of the present invention taken in conjunction with the appended drawing figures.

DETAILED DESCRIPTION OF THE PREFERRED EMBODIMENT

Reference will be made in detail to the preferred embodiment of the present invention.

Figure 1:
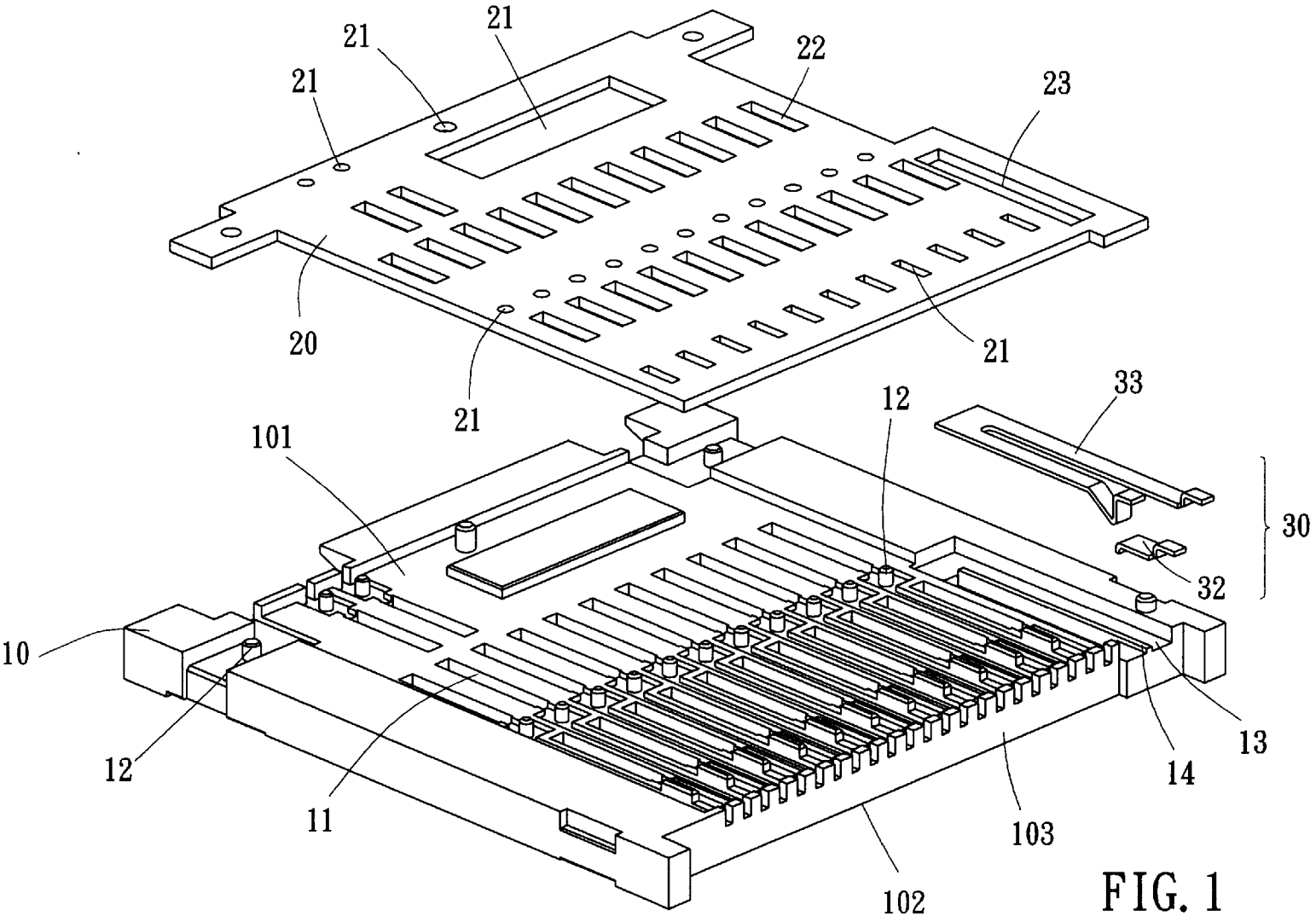
FIG. 1 is an exploded view of the card connector and switching means in accordance with the present invention.

Referring to FIG. 1, a card connector in accordance with the present invention comprises a main body 10, a cover 20 attached to a bottom face 101 of the main body 10, and switching means 30 disposed between the main body 10 and the cover 20 whereby when a card (not shown) is inserted into the card connector the switching means 30 will be activated to signal related circuitry before the card is fully inserted therein. The cover 20 defines several positioning openings 21, a plurality of rectangular apertures 22, and a window 23 therethrough.

Figure 3:
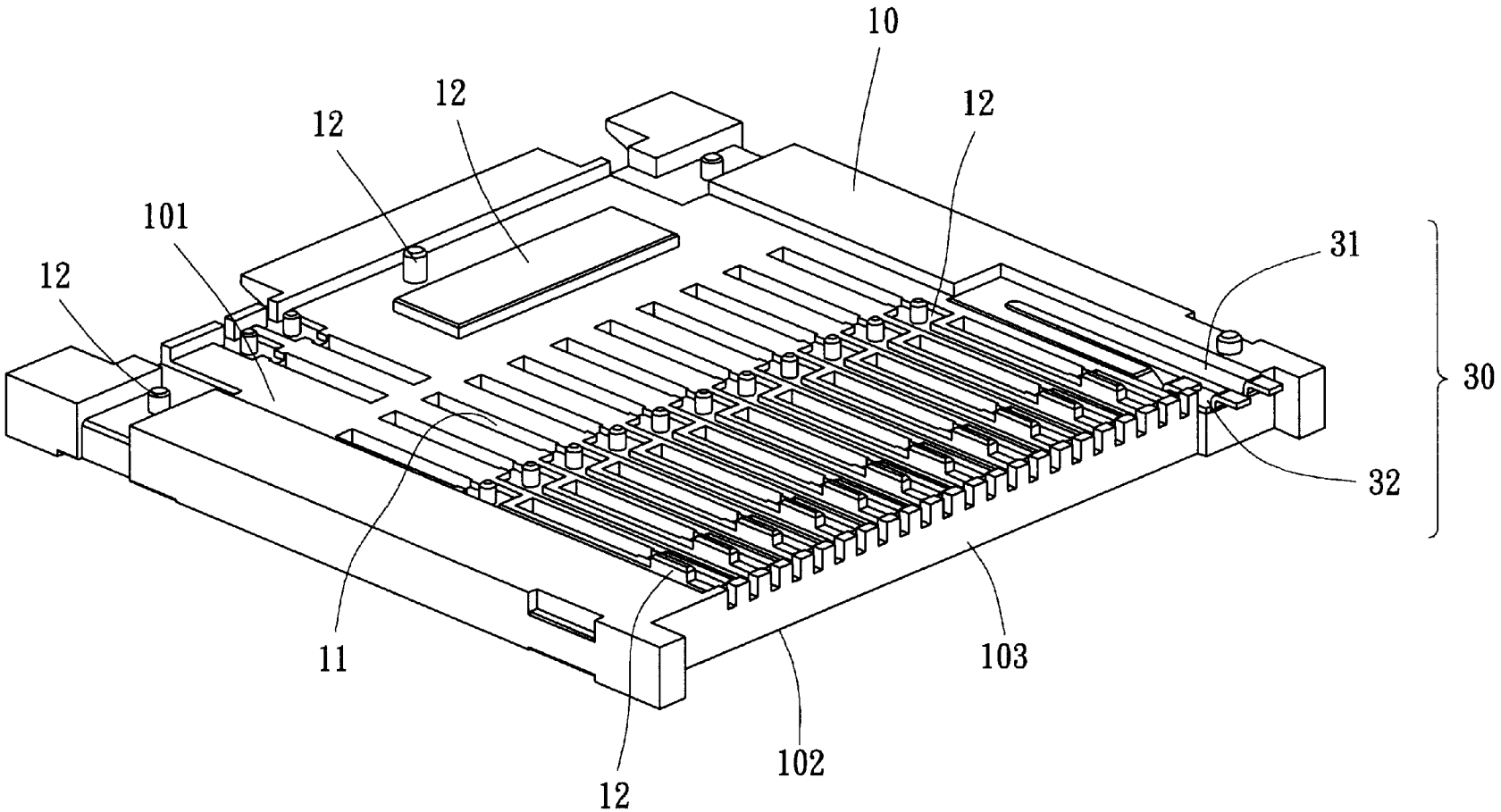
FIG. 3 is a perspective bottom view of a main body of the card connector.
Figure 4:
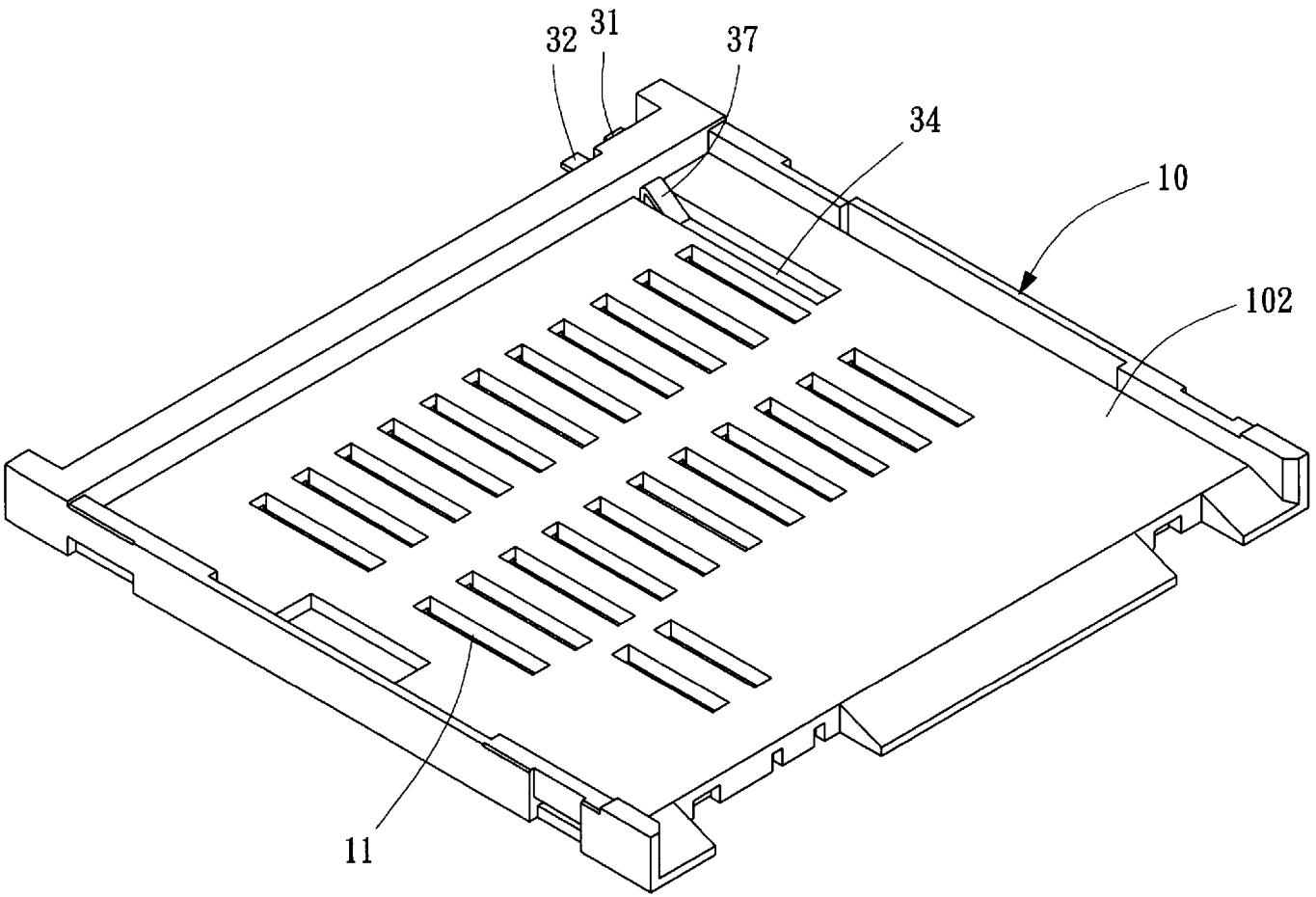
FIG. 4 is a perspective top view of the main body of the card connector.

Also referring to FIGS. 3 and 4, the main body 10 comprises the bottom face 101, a top face 102, and a mating face 103 formed between the top and bottom faces 101, 102 at one end thereof. A plurality of contact receiving passageways 11 is defined between the top and bottom faces 101, 102. Several positioning protrusions 12 are formed on the bottom face 101. A recess 13 for receiving the switching means 30 is defined in the bottom face 101 and exposed to the mating face 103. A separating wall 14 projects into the recess 13.

Figure 5:
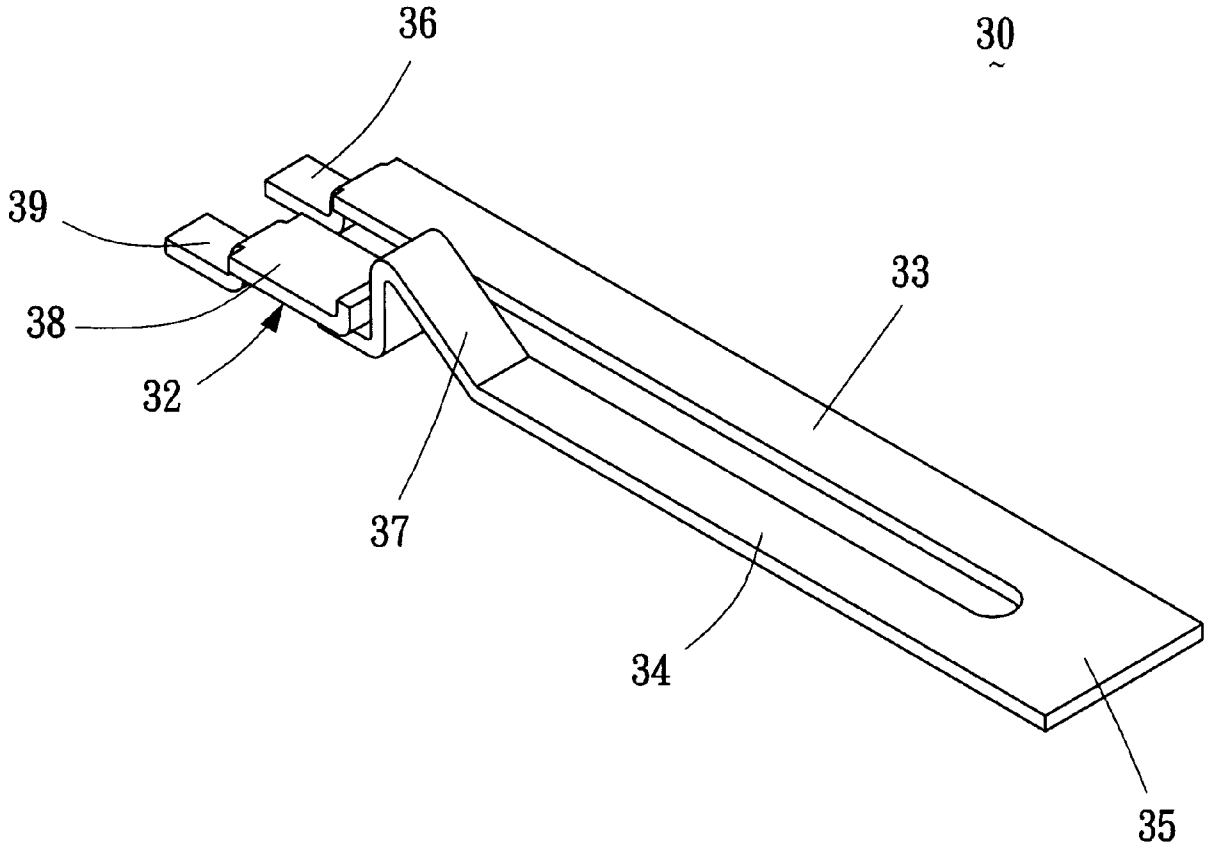
FIG. 5 is a perspective view of the switching means.
Figure 6:
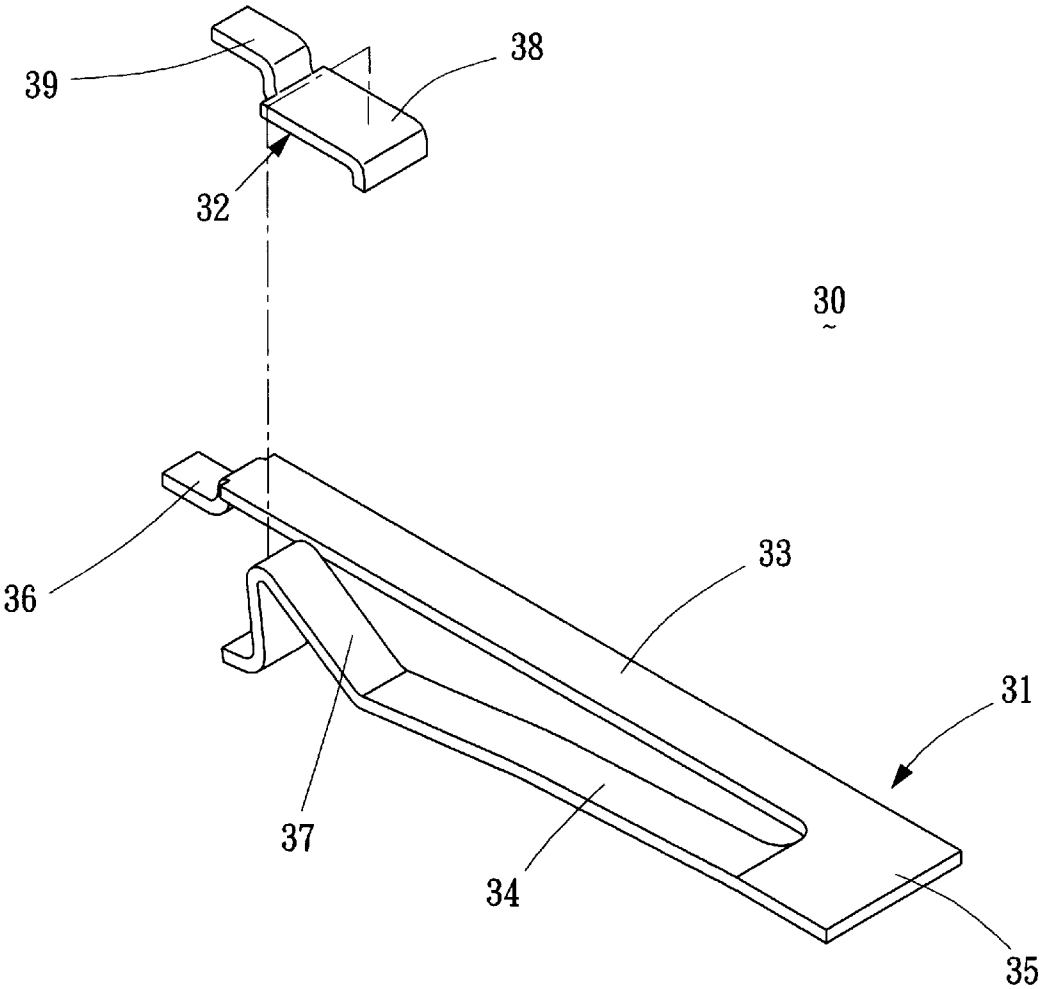
FIG. 6 is similar to FIG. 5 wherein two portions comprising the switching means are separated from each other.

As shown in FIGS. 5 and 6, the switching means 30 is stamped from a conductive material and comprises a first portion 31 and a second portion 32. The first portion 31 includes a first leg 33 and a second leg 34 parallel to the first leg 33. The legs 33, 34 are each connected to a base 35. The first leg 33 forms a solder pad 36 at a free end thereof. The second leg 34 forms a V-shaped projection 37 adjacent to a free end (not labeled) thereof. The second portion 32 comprises a base plate 38 and a solder pad 39 extending therefrom.

Figure 2:
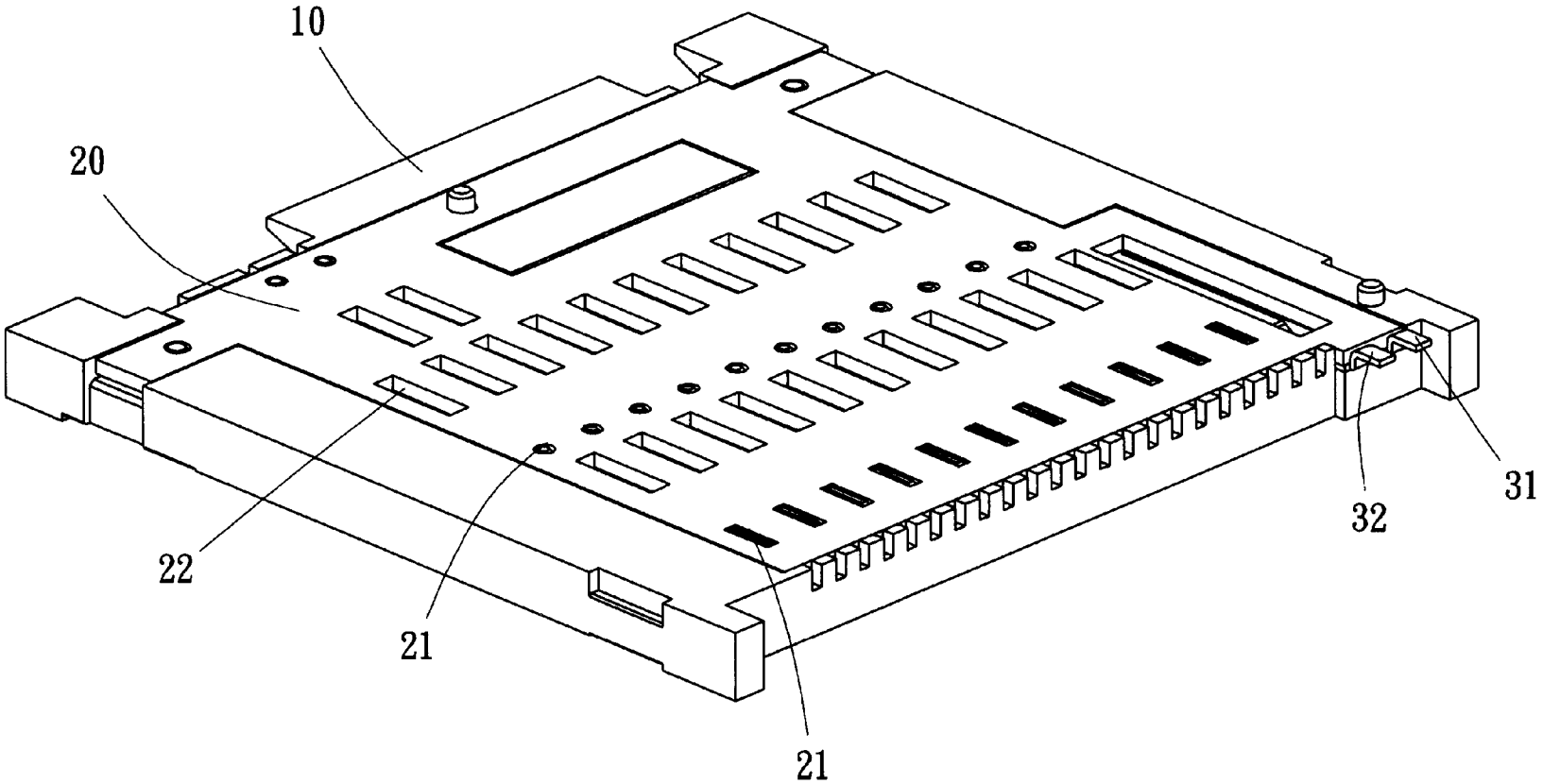
FIG. 2 is an assembled view of FIG. 1.

In assembly, the switching means 30 is received in the recess 13 of the main body 10 whereby the separating wall 14 is projects between the legs 33, 34 of the switching means 30. The V-shaped projection 37 projects beyond the top face 102 of the main body 10. The solder pads 36, 39 of the first leg 33 and the second portion 32 are soldered adjacent to each other on a related PCB (not shown) whereby the free end of the second leg 34 contacts the base plate 38 of the second portion 32. The cover 20 is attached to the main body 10 by inserting the positioning protrusions 12 of the main body 10 into the corresponding positioning openings 21 of the cover 20. A heat process is performed on the ends of the positioning protrusions 12 whereby a substance disposed thereon is melted. When the heat process is complete, the substance solidifies and the cover 20 is firmly attached to the main body 10. The apertures 22 and the window 23 of the cover 20 align with the passageways 11 and the recess 13 of the main body 10, respectively, as seen in FIG. 2.

The card connector is received in an opening defined in a computer housing (not shown) whereby a card can be inserted in a slot defined between the top face 102 of the main body 10 and the computer housing. Before the card is fully inserted into the slot, a front edge thereof will slide along the V-shaped projection 27 of the switching means 30 thereby causing the free end of the second leg 34 to electrically disengage from the second portion 32. The related circuitry is then signaled to indicate that a card is being received in the slot and can begin to execute the necessary operations before the card is fully inserted into the slot. While the card is received in the slot of the card connector, the second leg 34 projects through the window 23 of the cover 20.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A card connector comprising:

a main body having a bottom face, a top face, and a mating face formed between the top and bottom faces at one end thereof, and defining a plurality of contact receiving passageways between the top and bottom faces, a recess being defined in the bottom face of the main body and exposed to the mating face thereof;

a cover attached to the bottom face of the main body; and switching means disposed between the main body and the cover, having a first portion and a second portion, the first portion electrically engaging with the second portion when a card is not received in the card connector, the first portion including a first leg and a second leg parallel to the first leg extending from a base thereof;

wherein the switching means is received in the recess of the main body and a separating wall projects into the recess between the legs of the first portion of the switch means, whereby when a card is inserted into the card connector, the first portion disengages from the second portion before the card is fully inserted therein thereby signaling related circuitry that a card is being inserted into the card connector.

2. The card connector as described in claim 1, wherein the second leg forms a V-shaped projection adjacent to a free end thereof projecting beyond the top face of the main body for being displaced by a front edge of a card inserted into the card connector.

3. The card connector as described in claim 2, wherein a window is defined in the cover in alignment with the recess whereby the second leg of the first portion of the switching means projects therethrough when a card is received into the card connector.

4. The card connector as described in claim 1, wherein several positioning protrusions are formed on the bottom face of the main body for engaging with corresponding positioning openings defined in the cover.

5. The switching means as described in claim 1, wherein the first leg forms a first solder pad at a free end thereof for being soldered to a PCB.

6. The switching means as described in claim 1, wherein the second portion comprises a base plate for contacting the free end of the second leg of the first portion and a second solder pad extending therefrom for being soldered to a PCB.

7. A card connector comprising:

a main body defining a bottom face, an opposite top face;

a recess defined in the bottom face, a portion of said recess extending through the top face;

a cover attached to the bottom face of the main body; and a switching means retainably received within said recess, said switching means including a first portion integrally forming a base and first and second legs extending from the base and a second portion also extending from a base and mounted parallel to the first portion, the second leg having a V-shaped projection adjacent to a free end thereof, the second portion having a base plate for electrically contacting the free end of the second leg of the first portion when a card is not received in the card connector, and a second solder pad extending from the base plate of the second portion; wherein said first leg of the first portion connects to a first solder pad and said second leg extends out of the top face and detachably electrically connects to the base plate of the second portion and hence to the second solder pad of the second portion which is positioned beside said first solder pad.

8. A card connector comprising:

a main body having a bottom face, a top face, and a mating face formed between the top and bottom faces at one end thereof, and defining a plurality of contact receiving passageways between the top and bottom faces, the bottom face defining a recess;

a cover attached to the bottom face of the main body and defining a window in alignment with the recess of the main body; and switching means disposed between the main body and the cover and received in the recess of the main body, the switching means having a first portion and a second portion, the first portion including a first leg and a second leg parallel to the first leg extending from a base thereof, the second leg forming a V-shaped projection adjacent to a free end thereof projecting beyond the top face of the main body for being displaced by a front edge of a card inserted into the card connector, the first portion electrically engaging with the second portion when a card is not received in the card connector;

whereby when a card is inserted into the card connector, the first portion of the switching means disengages from the second portion and projects through the window of the cover before the card is fully inserted therein signaling related circuitry that a card is being inserted into the card connector.

9. A card connector comprising:

a main body having a bottom face, a top face, and a mating face formed between the top and bottom faces at one end thereof, and defining a plurality of contact receiving passageways between the top and bottom faces, the bottom face defining a recess therein;

a cover attached to the bottom face of the main body; and switching means disposed between the main body and the cover and received in the recess of the main body, the switching means being exposed to the mating face of the main body and having a first portion and a second portion, the first portion including a first leg and a second leg parallel to the first leg extending from a base thereof, the second portion forming a base plate for electrically contacting the free end of the second leg of the first portion when a card is not received in the card connector, and a solder pad extending therefrom for being soldered to a PCB;

whereby when a card is inserted into the card connector the first portion disengages from the second portion before the card is fully inserted therein thereby signaling related circuitry that a card is being inserted into the card connector.

* * * * *